US006973928B1

(12) United States Patent
Taylor, II et al.

(10) Patent No.: US 6,973,928 B1
(45) Date of Patent: Dec. 13, 2005

(54) TANK RETAINING DEVICE

(76) Inventors: William Taylor, II, P.O. Box 56, Felton, DE (US) 19943; John Skadsberg, P.O. Box 56, Felton, DE (US) 19943

( * ) Notice: Subject to any disclaimer, the term of this patent is extended or adjusted under 35 U.S.C. 154(b) by 11 days.

(21) Appl. No.: 10/719,248

(22) Filed: Nov. 21, 2003

(51) Int. Cl.[7] ..... A61M 15/00
(52) U.S. Cl. ..... 128/200.24; 128/201.27; 128/202.14; 128/204.26; 128/205.22
(58) Field of Search ..... 128/200.24, 201.29, 128/205.22, 201.27, 201.28, 202.14, 204.26; 224/153, 579, 580, 627

(56) References Cited

U.S. PATENT DOCUMENTS 1,636,766 A * 7/1927 Drager ..... 224/579
1,696,191 A * 12/1928 Coulson ..... 224/627
2,366,455 A * 1/1945 Patten ..... 244/147
2,400,077 A * 5/1946 Dauster ..... 2/183
2,402,984 A * 7/1946 Browne ..... 128/205.13
2,553,275 A * 5/1951 Quilter ..... 244/151 A
3,019,952 A * 2/1962 Brewster ..... 294/142
3,505,998 A * 4/1970 Brown et al. ..... 128/207.11
3,739,961 A * 6/1973 Soukeras ..... 224/579
4,213,549 A * 7/1980 Hibbard ..... 224/601
4,750,652 A * 6/1988 Grant ..... 224/627
4,790,463 A * 12/1988 Hansen ..... 224/680
4,804,218 A 2/1989 Hilliard
5,271,387 A 12/1993 Murray
5,370,113 A * 12/1994 Parsons ..... 128/205.22
5,607,258 A 3/1997 Eungard
5,950,894 A * 9/1999 Haber ..... 224/627
6,073,822 A * 6/2000 Swensen de Vidals ..... 224/629
6,152,342 A * 11/2000 Suk ..... 224/645
6,530,129 B1 * 3/2003 Cheng ..... 24/200

* cited by examiner

*Primary Examiner*—Aaron J. Lewis

(57) ABSTRACT

A tank retaining device for inhibiting a scuba tank from slipping downwardly in reference to a buoyancy control device. The tank retaining device includes a ring member having a diameter smaller than a scuba tank designed for abutting a bottom the of the scuba tank, and a plurality of strap members operationally coupled to the ring member, each one of the plurality of strap members is couplable to a tank securing strap of a buoyancy control device operationally coupled to the ring member.

6 Claims, 2 Drawing Sheets

TANK RETAINING DEVICE

BACKGROUND OF THE INVENTION

1. Field of the Invention

The present invention relates to scuba tank retaining devices and more particularly pertains to a new tank retaining device for inhibiting a scuba tank from slipping downwardly in reference to a buoyancy control device.

2. Description of the Prior Art

The use of scuba tank retaining devices is known in the prior art. U.S. Pat. No. 4,804,218 describes a device for facilitating transport of scuba tanks when not actively in use. Another type of scuba tank retaining devices is U.S. Pat. No. 5,271,387 for coupling an auxiliary tank to a main tank.

While these devices fulfill their respective, particular objectives and requirements, the need remains for a device that secures a scuba tank, when in use, from slipping downwardly.

SUMMARY OF THE INVENTION

The present invention meets the needs presented above by working with a standard tank securing strap commonly provided as part of a buoyancy control device to prevent slippage.

Another object of the present invention is to provide a new tank retaining device that improves diver safety by preventing an anxiety producing event.

Still another object of the present invention is to provide a new tank retaining device that is light weight and can be used with existing conventional equipment.

To this end, the present invention generally comprises a ring member having a diameter smaller than a scuba tank designed for abutting a bottom the of the scuba tank, and a plurality of strap members operationally coupled to the ring member, each one of the plurality of strap members is couplable to a tank securing strap of a buoyancy control device operationally coupled to the ring member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
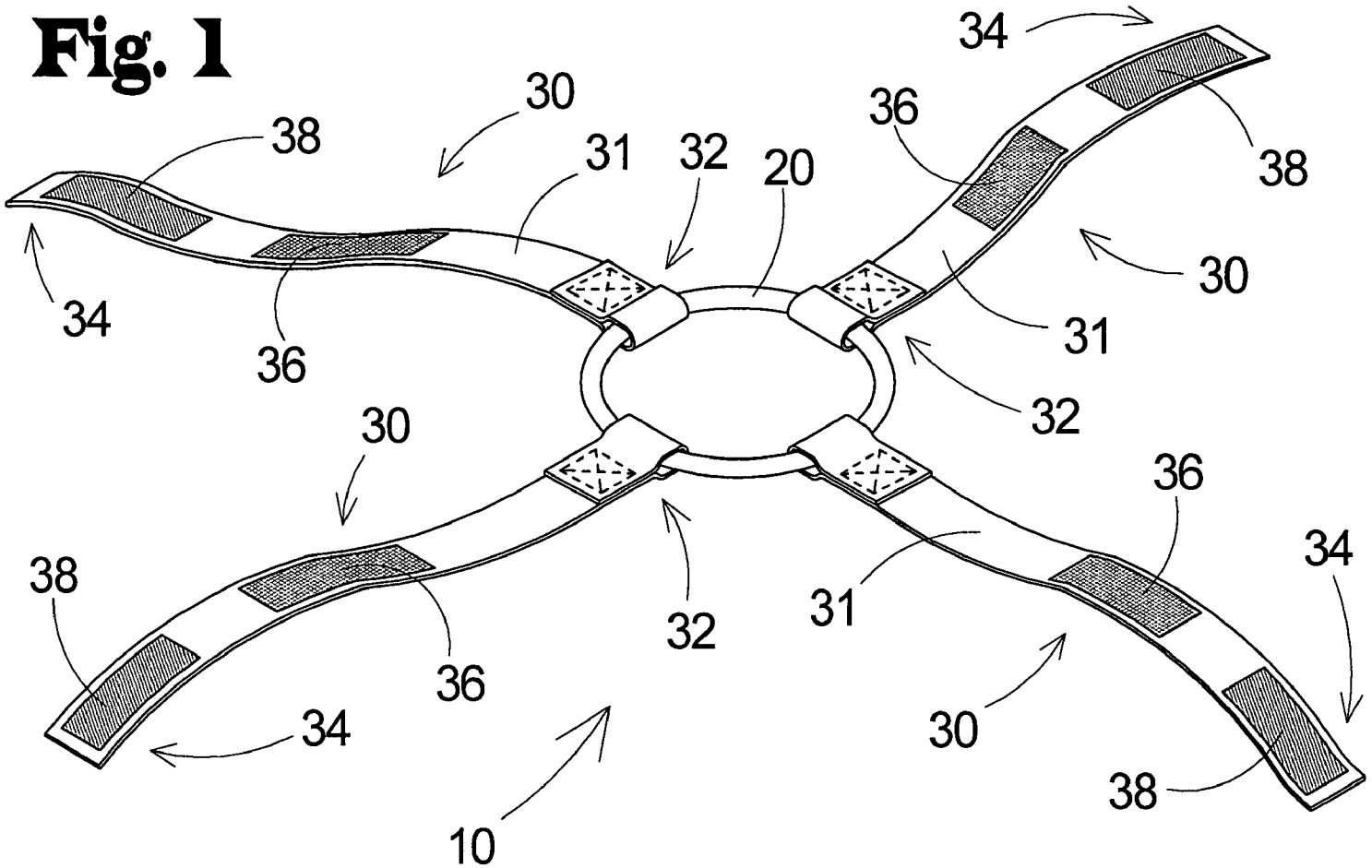
FIG. 1 is a schematic perspective view of a new tank retaining device according to the present invention.
Figure 2:
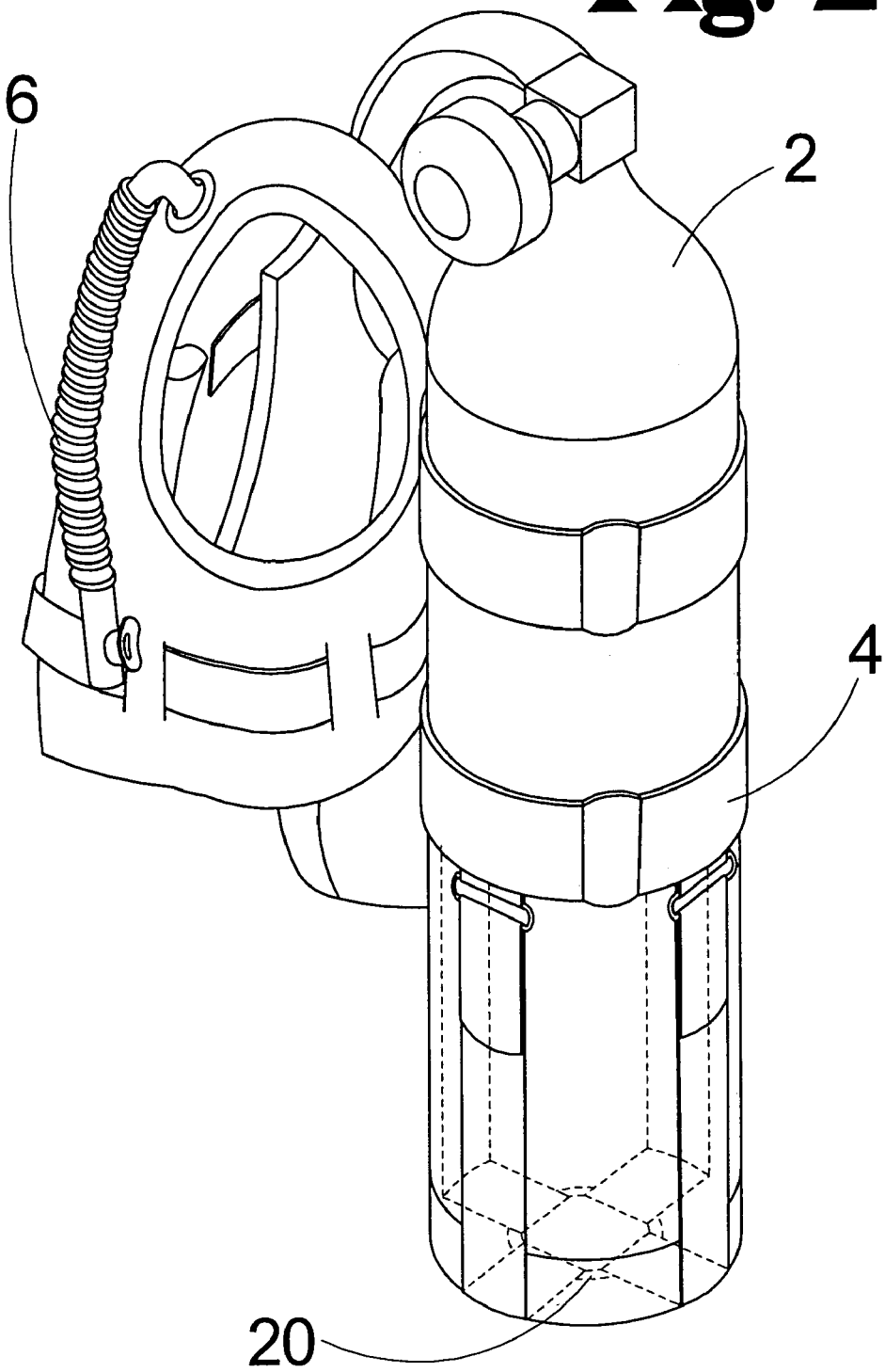
FIG. 2 is a schematic perspective view of the present invention in use.

With reference now to the drawings, and in particular to FIGS. 1 and 2 thereof, a new tank retaining device embodying the principles and concepts of the present invention and generally designated by the reference numeral 10 will be described.

As best illustrated in FIGS. 1 and 2, the tank retaining device 10 generally comprises a ring member 20 and a plurality of strap members 30.

The ring member 20 preferably has a diameter smaller than a scuba tank 2. The ring member 20 is for abutting a bottom the of the scuba tank 2.

Each one of the plurality of strap members 30 has a distal end 34 and a proximal end 32. Each proximal end 32 is operationally coupled to the ring member 20. Each one of the distal ends 34 of the plurality of strap members 30 is couplable to a tank securing strap 4 of a buoyancy control device 6.

The plurality of strap members 30 and the ring member 20 inhibits the scuba tank 2 from slipping downwardly in reference to the buoyancy control device 6.

A first fastening means 36 is preferably positioned adjacent to the distal end 34 and on a first side 31 of the strap member 30.

A second fastening means 38 is preferably positioned centrally on the strap member 30 and also on the first side 31 of the strap member 30. The second fastening means 38 is complementary to the first fastening means 36.

The first fastening means 36 is selectively couplable with the second fastening means 38 to facilitate securing the strap member 30 to the tank securing strap 4 of the buoyancy control device 6.

In a preferred embodiment the first fastening means 36 comprises an first portion of hook and loop fastener and the second fastening means 38 comprises a second portion of hook and loop fastener. While hook and loop fastener is preferred, snaps, buttons, clips, d-rings, or any other suitable device may also be employed.

Preferably each one of the strap members 30 having a width of one inch.

In a preferred embodiment the four strap members are used, each coupled to an associated quadrant of the ring member. However, the use of two or more straps can also be sufficient.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A tank retaining system for use with a conventional buoyancy control device comprising:

a scuba tank being received the buoyancy control device such that said buoyancy control device is mounted on said scuba tank;

a ring member having a diameter smaller than said scuba tank, said ring member being for abutting a bottom wall of said scuba tank;

a plurality of strap members, each one of said plurality of strap members having a distal end and a proximal end, each proximal end being operationally coupled to said ring member, each one of said distal ends of said plurality of strap members being couplable to a tank securing strap of the buoyancy control device; and said plurality of strap members and said ring member inhibiting said scuba tank from slipping downwardly in reference to the buoyancy control device.

2. The system of claim 1, wherein each one of said plurality of strap members further comprises:

a first fastening means positioned adjacent to said distal end, said first fastening means being positioned on a first side of said strap member;

a second fastening means positioned centrally on said strap member, said second fastening means being positioned on said first side of said strap member, said second fastening means being complementary to said first fastening means;

said first fastening means being selectively couplable with said second fastening means to facilitate securing said strap member the tank securing strap of the buoyancy control device.

3. The system of claim 2, wherein said first fastening means comprises a first portion of hook and loop fastener and said second fastening means comprises a second portion of hook and loop fastener.

4. The system of claim 1, wherein each one of said strap members having a width of one inch.

5. The system of claim 1, wherein said plurality of strap members comprises four strap members.

6. A tank retaining system for use with a conventional buoyancy control device comprising:

a scuba tank being received the buoyancy control device such that said buoyancy control device is mounted on said scuba tank;

a ring member having a diameter smaller than said scuba tank, said ring member being for abutting a bottom wall of said scuba tank;

a plurality of strap members, each one of said plurality of strap members having a distal end and a proximal end, each proximal end being operationally coupled to said ring member, each one of said distal ends of said plurality of strap members being couplable to a tank securing strap of the buoyancy control device;

said plurality of strap members and said ring member inhibiting said scuba tank from slipping downwardly in reference to the buoyancy control device;

a first fastening means positioned adjacent to said distal end, said first fastening means being positioned on a first side of said strap member;

a second fastening means positioned centrally on said strap member, said second fastening means being positioned on said first side of said strap member, said second fastening means being complementary to said first fastening means;

said first fastening means being selectively couplable with said second fastening means to facilitate securing said strap member the tank securing strap of the buoyancy control device;

wherein said first fastening means comprises an first portion of hook and loop fastener and said second fastening means comprises a second portion of hook and loop fastener;

wherein each one of said strap members having a width of one inch;

wherein said plurality of strap members comprises four strap members.

* * * * *